US009770810B2

(12) United States Patent
Schauss et al.

(10) Patent No.: US 9,770,810 B2
(45) Date of Patent: Sep. 26, 2017

(54) PIN CLAMP

(71) Applicant: DE-STA-CO Europe GmbH, Oberursel (DE)

(72) Inventors: Peter Schauss, Florsheim (DE); Aravind Dugganna Naik, Bangalore (IN); Michael Joanes Chaumet, Nonette (FR)

(73) Assignee: DE-STA-CO Europe GmbH, Oberursel (DE)

( * ) Notice: Subject to any disclaimer, the term of this patent is extended or adjusted under 35 U.S.C. 154(b) by 22 days.

(21) Appl. No.: 14/538,990

(22) Filed: Nov. 12, 2014

(65) Prior Publication Data

US 2016/0129558 A1 May 12, 2016

(51) Int. Cl.

| | |
|---|---|
| ***B25B 1/08*** | (2006.01) |
| ***B25B 5/16*** | (2006.01) |
| ***B25B 5/06*** | (2006.01) |

(52) U.S. Cl.

CPC ..... *B25B 5/163* (2013.01); *B25B 5/061* (2013.01)

(58) Field of Classification Search

USPC ..... 269/229, 32.27, 228, 20–26

See application file for complete search history.

(56) References Cited

U.S. PATENT DOCUMENTS 4,134,306 A 1/1979 Grotness et al.
4,244,618 A 1/1981 Boyer et al.
4,421,137 A 12/1983 Nusbaumer et al.
4,577,898 A 3/1986 Nusbaumer et al.
4,607,873 A 8/1986 Nusbaumer et al.
5,241,896 A 9/1993 Braun et al.
5,941,513 A 8/1999 Moilanen et al.
6,048,013 A 4/2000 Moilanen et al.
6,056,281 A 5/2000 Moilanen et al.
6,059,277 A * 5/2000 Sawdon ..... B25B 5/16 269/24
6,176,533 B1 1/2001 Moilanen et al.
6,227,586 B1 5/2001 Moilanen et al.
6,273,408 B1 8/2001 Moilanen et al.
6,276,733 B1 8/2001 Moilanen et al.
6,302,462 B2 10/2001 Moilanen et al.
6,322,118 B2 11/2001 Moilanen et al.
6,378,855 B1 * 4/2002 Sawdon ..... B21F 3/02 123/634
6,425,616 B2 7/2002 Moilanen et al.
6,439,560 B2 * 8/2002 Sawada ..... B25B 5/087 269/32
6,530,616 B1 3/2003 McIntosh et al.
6,598,918 B1 7/2003 Null et al.
(Continued)

FOREIGN PATENT DOCUMENTS

JP EP 1055474 A1 * 11/2000 ..... B23B 31/185
WO WO 2008157698 A2 * 12/2008 ..... B25B 5/087

*Primary Examiner* — Larry E Waggle, Jr.
*Assistant Examiner* — Alvin Grant
(74) *Attorney, Agent, or Firm* — Harness, Dickey & Pierce, P.L.C.

(57) ABSTRACT

A pin clamp assembly has a housing, an actuating device and a movable locating pin. A clamping device is coupled with the actuating device to move within the locator pin. The clamping device includes a rod and a finger. The finger extends and retracts in and out of the locating pin to enable the locating pin and clamping device to be moved so that the clamping finger clamps a workpiece.

7 Claims, 6 Drawing Sheets

(56) References Cited

U.S. PATENT DOCUMENTS 6,641,189 B2 11/2003 Moilanen et al.
6,857,780 B2 2/2005 Morr et al.
6,874,834 B2 4/2005 McIntosh et al.
6,929,254 B2 8/2005 Steele et al.
6,948,708 B2 9/2005 Moilanen et al.
7,111,834 B2 9/2006 Steele et al.
7,156,385 B2 * 1/2007 Mulder ..... F15B 15/24 269/24
7,182,326 B2 2/2007 McIntosh et al.
7,229,068 B2 6/2007 Moilanen
7,328,924 B2 2/2008 Moilanen et al.
7,370,856 B2 * 5/2008 Sawdon ..... B25B 5/062 269/27
7,448,607 B2 11/2008 Steele et al.
7,467,788 B2 12/2008 McIntosh et al.
7,516,948 B2 * 4/2009 McIntosh ..... B25B 5/062 269/27
7,584,946 B2 * 9/2009 Doi ..... B25B 5/08 269/225
7,686,286 B2 * 3/2010 Colby ..... B25B 5/087 269/24
7,815,176 B2 10/2010 McIntosh et al.
8,104,751 B2 * 1/2012 Timtner ..... G01M 1/04 269/24
8,132,798 B2 3/2012 Mcintosh et al.
8,132,799 B2 * 3/2012 McIntosh ..... B25B 5/062 269/27
8,132,801 B2 * 3/2012 Miyashita ..... B25B 5/087 269/228
8,146,900 B2 * 4/2012 Miyashita ..... B23K 37/0435 269/228
8,376,336 B2 * 2/2013 McIntosh ..... B23Q 16/001 269/24
8,413,970 B2 4/2013 McIntosh
8,459,626 B2 * 6/2013 Sawdon ..... B25B 5/062 269/228
8,561,974 B2 10/2013 Steele et al.
8,967,604 B2 * 3/2015 Fleischer ..... B25B 5/062 269/228
2004/0041323 A1 * 3/2004 Migliori ..... B25B 5/16 269/32
2004/0159996 A1 * 8/2004 Migliori ..... B25B 5/122 269/32
2005/0012258 A1 * 1/2005 Migliori ..... B25B 5/122 269/32
2005/0017423 A1 * 1/2005 Kita ..... B25B 5/16 269/32
2005/0017424 A1 * 1/2005 Migliori ..... B25B 5/16 269/32
2005/0035516 A1 * 2/2005 Sawdon ..... B25B 5/087 269/32
2005/0040578 A1 * 2/2005 Sawdon ..... B25B 5/062 269/32
2005/0051939 A1 * 3/2005 Beffrieu ..... B25B 5/087 269/32
2005/0225017 A1 * 10/2005 Sakamoto ..... B25B 5/087 269/32
2005/0242483 A1 * 11/2005 McIntosh ..... B25B 5/062 269/32
2006/0049565 A1 * 3/2006 Petit ..... B25B 5/087 269/32
2006/0125167 A1 * 6/2006 Steele ..... B25B 5/087 269/32
2007/0069439 A1 * 3/2007 McIntosh ..... B25B 5/087 269/32
2011/0031670 A1 * 2/2011 Kawakami ..... B23Q 1/009 269/32
2014/0103589 A1 * 4/2014 McIntosh ..... B23Q 3/08 269/32
2015/0336242 A1 * 11/2015 Zajac, Jr. ..... B25B 5/122 269/32

* cited by examiner

PIN CLAMP

FIELD

The present disclosure relates to a pin clamp and, more specifically, to a pin clamp with a retractable clamp assembly.

BACKGROUND

Pin clamp assemblies have been known for numerous years in robotic and manufacturing applications. Pin clamp assemblies may be used with a robot end effector to clamp a workpiece or material at a specific workstation such that an operation can be performed on the workpiece. The pin assembly can utilize a movable locator pin coupled with a clamping mechanism to clamp to the workpiece. A number of movable locator pin assemblies are available in the art. However, the operating mechanism for moving locator pin and the clamping mechanism are very complicated. The prior art requires bent rods and cams to control the extension and retraction of the clamping fingers. The bent rods are driven by various cams and the like to accomplish the requested movement. The present disclosure provides the art with a simple mechanism to drive the locator pin and the clamping mechanism.

Accordingly, the present disclosure provides the art with a simple mechanism to move the locator pin and extend and retract the clamping finger. The present disclosure provides a linear movement from an actuator to extend and retract the clamping fingers and drive the locator pin.

SUMMARY

According to the disclosure, a pin clamp assembly comprises a housing with a cavity in the housing and a bore extending from the cavity through the housing wall. An actuating device is coupled with the housing. A movable locating pin is positioned in the housing bore. The locating pin includes an internal bore and at least one aperture through the locator pin wall to the bore. A clamping device is coupled with the actuating device. The clamping device includes a movable rod positioned in the pin locator bore and at least one finger. The finger is located in the locator pin aperture and is coupled with the rod. A member extends from the rod or the finger. A slot is formed on the rod or the finger to receive the extending member. Reciprocation of the rod in the locator bore moves the at least one finger, in the locator pin aperture, between an extended and a retracted position. In the extended position, the rod moves the locator pin and the at least one finger into a clamping position. The rod includes an annular flange that moves in an enlarged bore portion of the locator pin. The rod includes the extending member with a tapered surface. The rod includes a flat planar head with the extending tapered surface on one side. A piston rod extension couples between the rod and the actuator device. The piston rod extension is positioned in the housing cavity and threadedly secured on the piston rod. A stop is positioned in the enlarged bore portion of the locator pin to contact the rod flange. An anti-rotation device is coupled with the locator pin to prohibit rotation of the locator pin.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Figure 1:
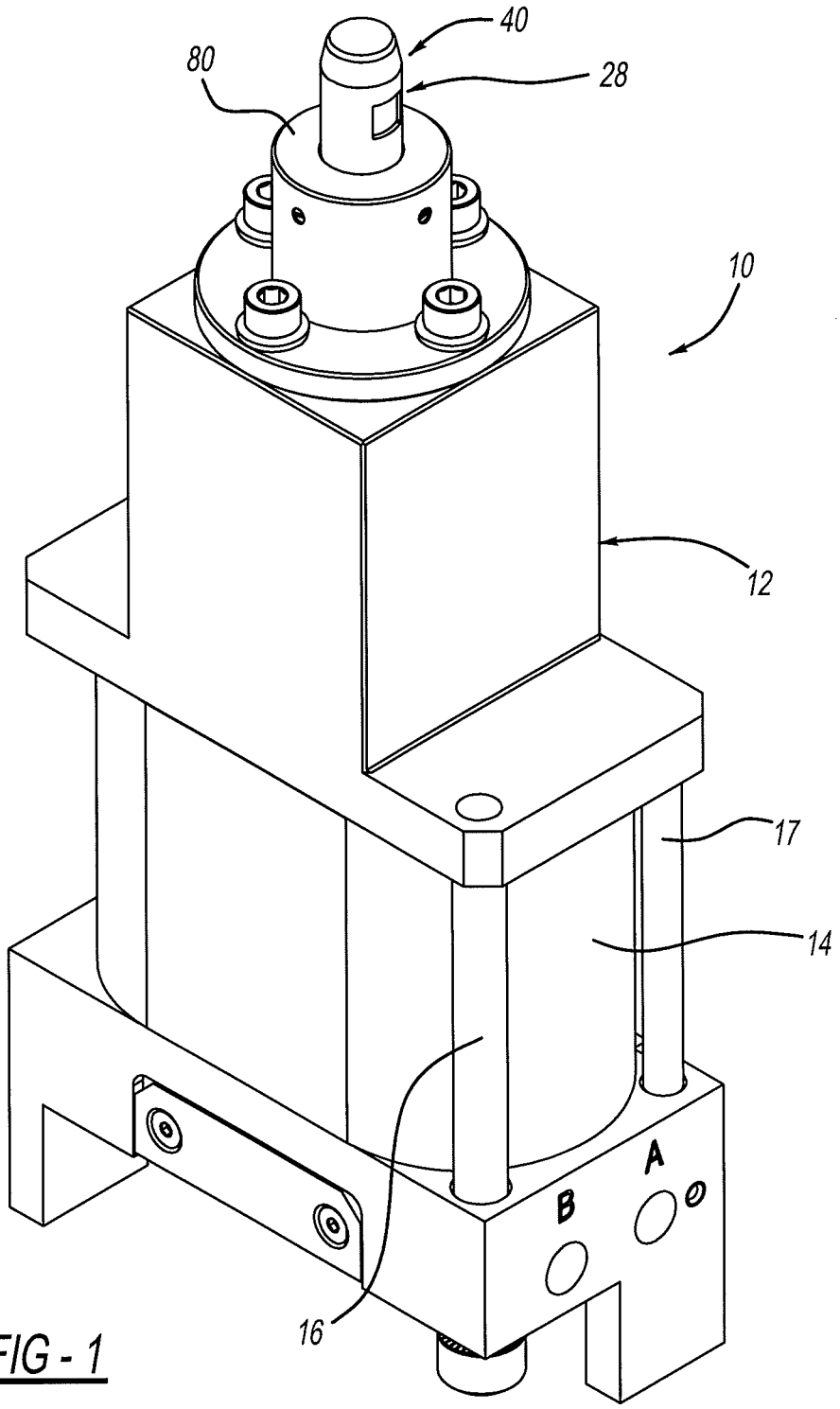
FIG. 1 is a perspective view of the pin clamp assembly.
Figure 2:
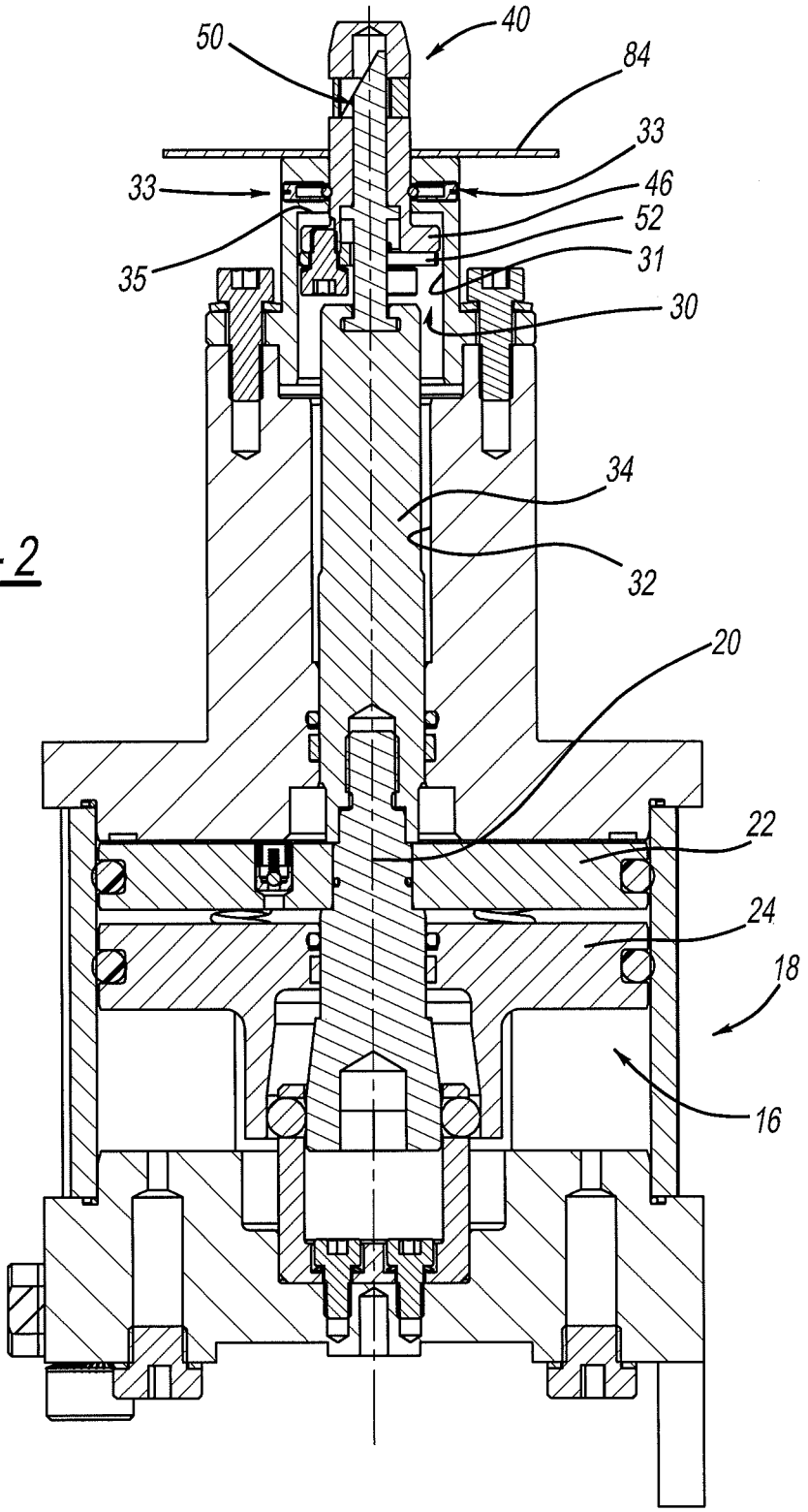
FIG. 2 is a cross-section of FIG. 1 in the first position.
Figure 3:
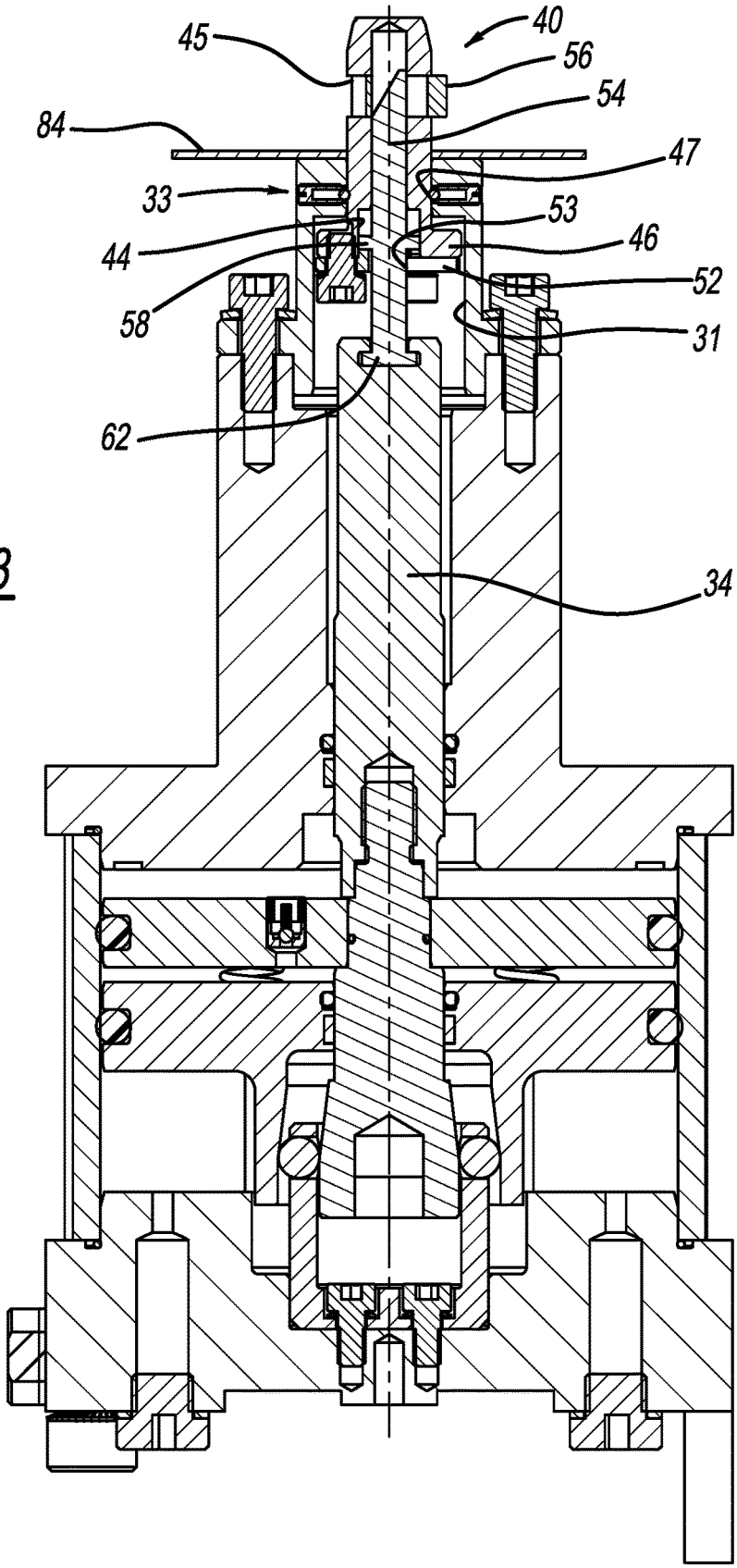
FIG. 3 is the same view as FIG. 2 in a second position.
Figure 4:
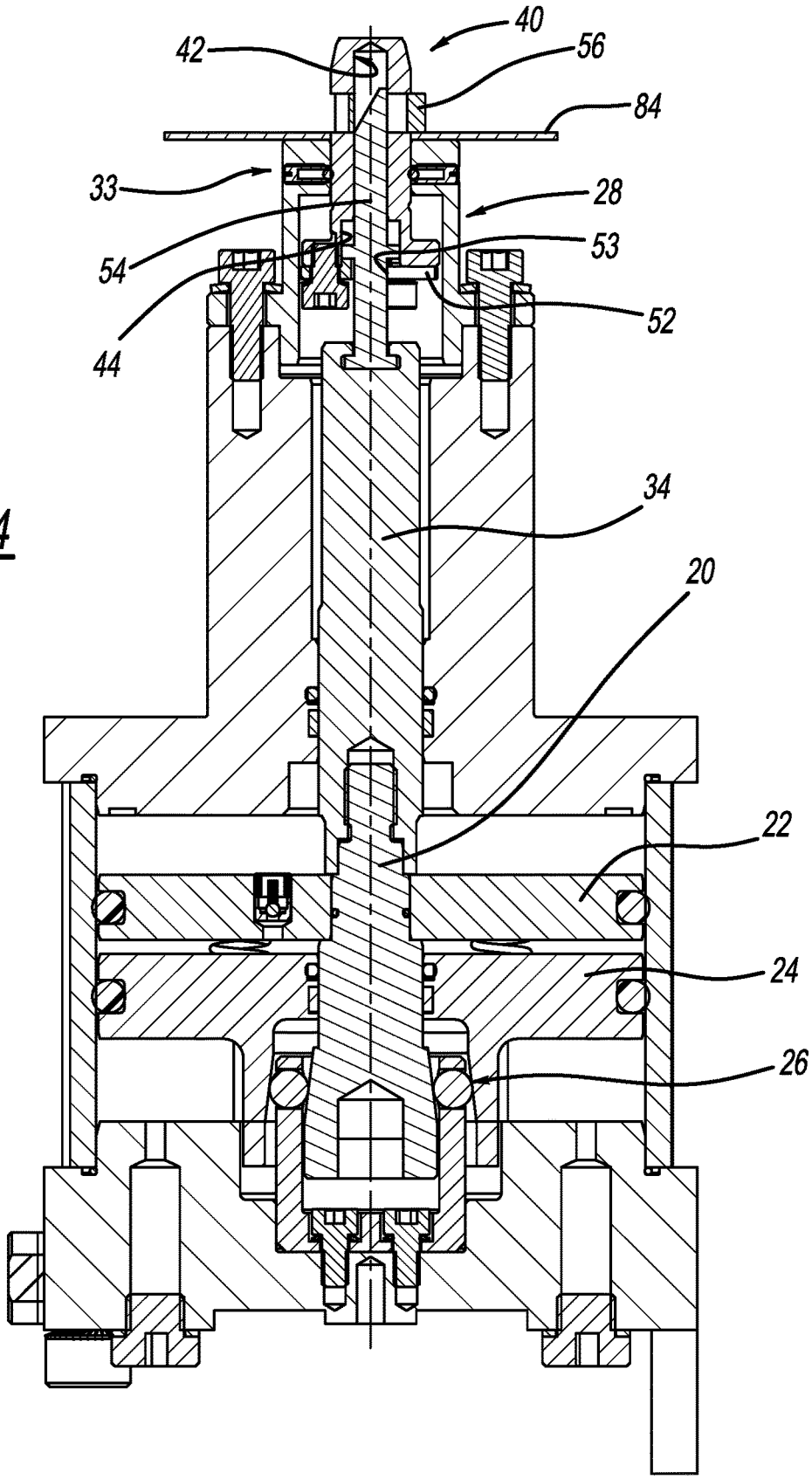
FIG. 4 is the same view as FIG. 2 in a third position.
Figure 5:
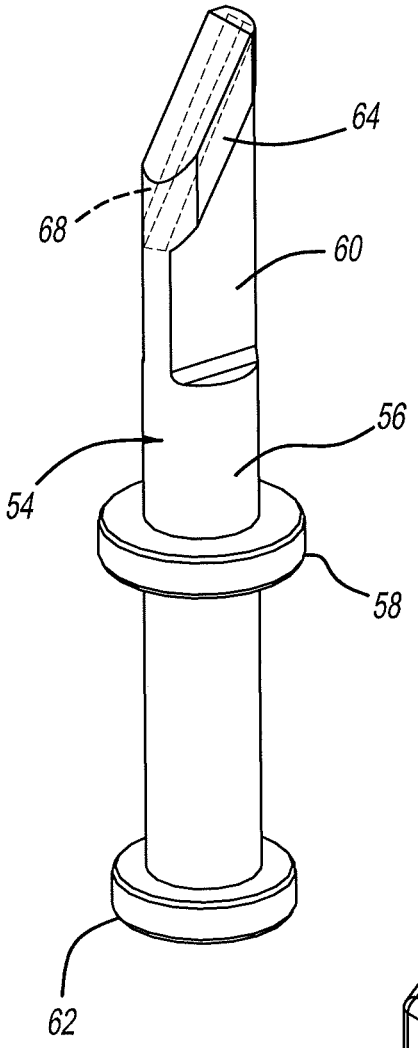
FIG. 5 is a perspective view of a locator pin rod.
Figure 6:
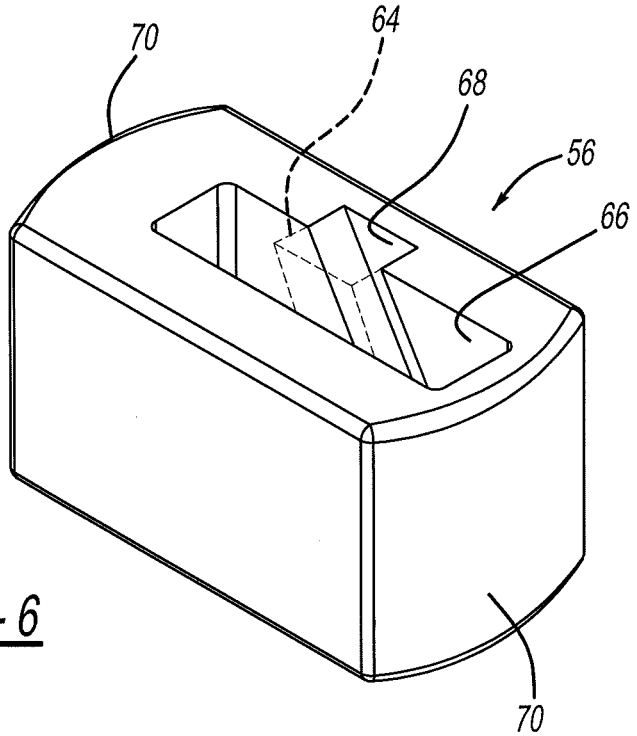
FIG. 6 is a perspective view of a clamping finger.

Turning to FIG. 1, a pin clamping assembly is illustrated and designated with the reference numeral 10. The pin clamping assembly includes a housing 12 and an actuator 14. The actuator device 14 is illustrated as an oval shaped piston cylinder including diagonally mounted studs 16 attaching it to the housing 12. Also, a conduit 17 provides fluid to the piston cylinder. However, a round piston cylinder, either pneumatic or hydraulic, as well as an electrical actuator could be used.

The actuating mechanism includes a piston assembly 16 positioned inside of the actuating cylinder 18. The piston assembly 16 includes a piston rod 20 and a pair of pistons 22, 24. The fluid acts on piston 22 moving both pistons 22, 24 in a first or downward direction as illustrated in the figures. Piston 24 is locked onto a detent 26 when the piston 24 reaches a bottom dead center position. This locks the piston rod 20 in position. Fluid enters below the second piston 24 returning both of the pistons in a second direction to their first position.

The housing 12 includes an adapter 28 secured to an end of the housing 12. The adapter 28 has an overall cylindrical configuration with a through bore 30. The through bore 30 has an enlarged bore portion 31. The enlarged bore portion 31 receives a cylindrical portion 46 of the locator pin 40. The adapter 28 includes at least one anti-rotation mechanism 33 that are positioned in bores 35. The anti-rotation mechanism 33 includes a housing with a spring biased detent ball. The ball contacts the locator pin 40 to prohibit rotation of the locator pin 40. The housing 12 includes a cavity 32 that receives the piston rod extension 34. The piston rod extension 34 is connected at one end, via a threaded connection, with the piston rod 20. The other end includes an annular cut out to receive the clamping mechanism rod 54.

A locator pin 40 is positioned within the adapter 28. The locator pin 40 houses a clamping mechanism 50.

The locator pin 40 has an elongated cylindrical shape with a central bore 42. The central bore 42 includes an enlarged portion 44 at one end of the locator pin 40. At least one aperture 45 is formed in the wall of the locator pin 40 that extends radially into the central bore 42. The locator pin outer circumferential surface includes at least one cut out 47 to receive the detent ball to prohibit rotation. Also, the locator pin 40 includes an enlarged annular portion 46 that fits within the adapter bore enlarged portion 31. The locator pin 40 moves within the bore 30 of the adapter 28. This enables the locator pin 40 to move in a first and second reciprocal direction.

The clamping mechanism 50 is movably retained in the locator pin 40 by a stop 52. The stop 52 is positioned at an end of the enlarged bore portion 44. The stop 52 includes a slot 53 to receive the rod 54 of the clamping mechanism 50. The stop 52 is secured to the enlarged annular portion 46 of the locator pin 40.

The clamping mechanism 50 includes a rod 54 and a finger 56. The rod 54 has a cylindrical body 56 with annular flanges 58, 62. Additionally, the rod 54 includes a head 60 that is substantially flat and planar. The rod annular flange 62 fits into the annular cut out of the piston rod extension 34 to couple the rod 54 with the piston rod extension 34. The rod 54 is directly driven by the piston rod extension 34 which, in turn, is directly driven by the piston rod 20. Thus, the rod 54 drives the locator pin 40 in its reciprocating pattern.

The flat head 60 includes a projecting member or shelf 64 on one side of the head 60. The projecting member or shelf 64 has a tapered surface slid inside the finger 56. The projecting member or shelf 64 is the terminus of the head 60 and provides a top tapered surface. The projecting member or shelf 64 is the terminus of the head 60 and provides a top tapered surface. Also, a slot is shown in phantom so that the shelf spot can be reversed.

The finger 56 has an overall rectangular box shape with a central slot 66. The central slot 66 includes a side slot 68. The side slot 68 has tapered surfaces to receive the tapered surfaces of the projecting member 64 of the head 60. The central slot 66 receives the rod head 60. A projection member is shown in phantom. Additionally, the finger 56 includes two minor sides 70 with an arcuate surface. The arcuate surface 70 enables the finger 56 to circumferentially align with the wall of the locator pin 40. Thus, when the finger 56 is in a retracted position in the locator pin 40, the aperture 45 in the locator pin 40 is closed. Thus, weld slag or the like is prohibited from entering into the locator pin. Thus, the minor sides 70 are substantially flush with the circumferential surface of the locator pin 40.

Figure 7:
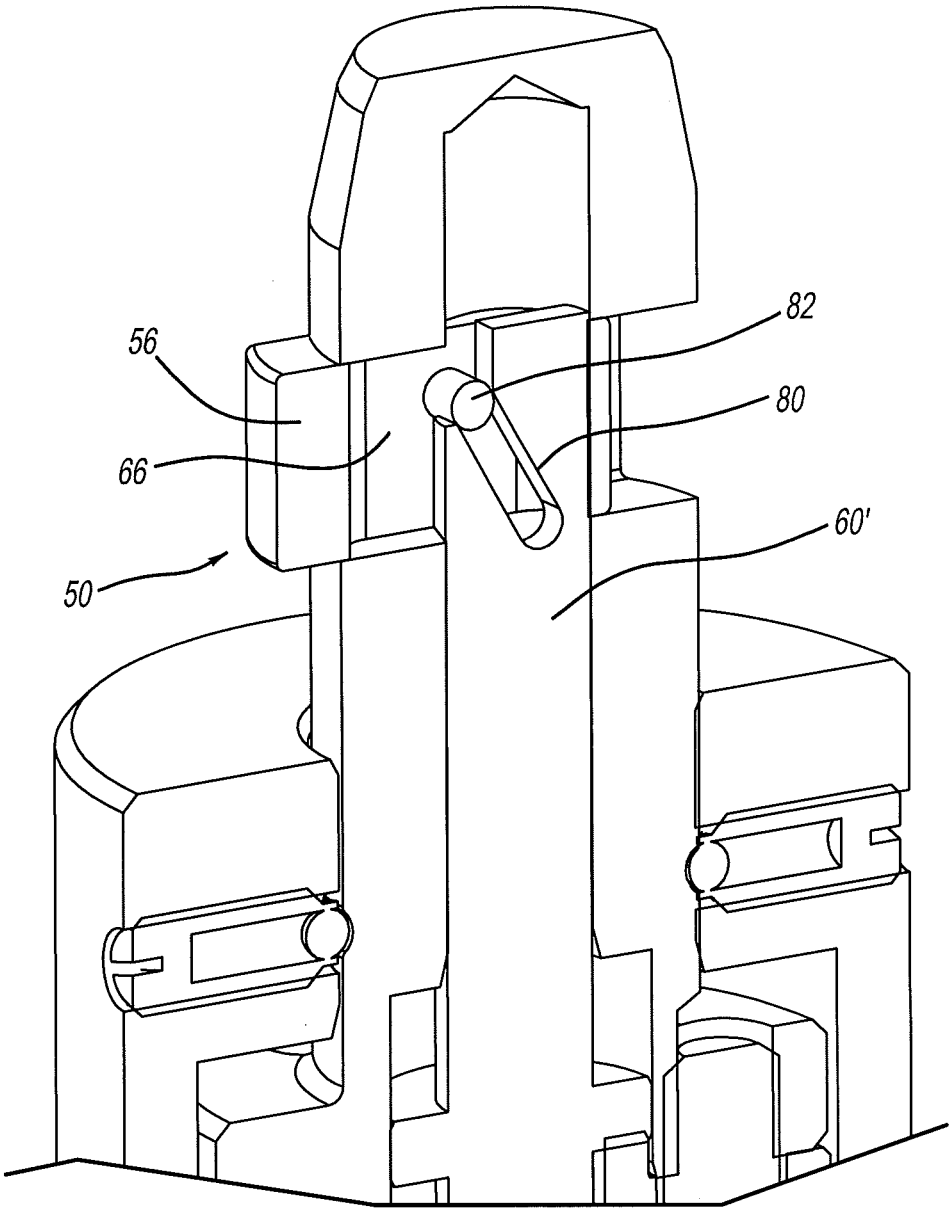
FIG. 7 is a cross-section of a second embodiment of the pin clamp.

FIG. 7 illustrates the clamping mechanism 50. The elements that are the same as previously discussed will be identified with the same reference numerals. The difference between the first embodiment lies in the rod head 60' and the finger 56'.

The rod head 60' includes an angled slot 80 formed near the free end of the head 60'. The finger 56' includes central slot 66. A pin 82 extends from the sides to span the central slot 66. The slot 80 and head 60' engages the pin 82. As the rod 54 reciprocates, the pin moves in the slot 80. As the pin 82 moves in the slot 80, the finger 56 reciprocates in the locator pin 40 from an extended and retracted position. Additionally, the pin could extend from the rod head 60' and slots could be formed in the sides of the finger 56'.

In operation, fluid enters into the actuator device moving piston 22 in a first direction. As this occurs, the clamping member 50 is driven. Since the locator pin 40 is dependent upon movement of the clamping member 50, it also moves in the adapter 28. The clamping member rod 54 moves in the bore 42 of the locator pin 40. As this occurs, the tapered surface 64 of the projecting member slides on the tapered surface of slot 68 forcing the finger 56 outward through the aperture 45. Thus, the finger 56 extends from the locator pin 40. This continues until the flange 58 contacts the stop 52 at the terminus of the enlarged bore 44.

As the fluid continues to enter into the actuating device 14, the piston rod 20 continues to move in the first direction. As this occurs, the extension 34 continues to draw the rod 54 in a first direction which, in turn, moves the locator pin 40. Fluid continues to enter into the actuating device 14. As this occurs, the locator pin 40 dependent upon the rod 54 movement, as well as the clamping device 50, continues to move in the first direction until the clamping finger 56 contacts a workpiece 84 positioned on the surface 80 of the adapter 28. Also, as the actuating device 12 reaches this position, the piston 24 locks in place, via the detent 26. Thus, the clamping device 50 is locked in position on the workpiece. To release the clamping member 50, fluid enters the cylinder 12 on a side of the piston 24. The piston 24 moves in a second direction which reverses the direction of the piston rod 20 and extension 34. This forces the rod 54 in the second direction which, in turn, retracts the finger 56 into the locating pin 40. The rod 54 then drives the locator pin 40 into its position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pin clamp comprising:

a housing, a cavity in the housing, a bore through a housing wall from the cavity;

an actuating device coupled with the housing;

a movable locator pin in the housing bore, the locator pin including an internal bore and at least one aperture through a locator pin wall to the bore;

a clamping device coupled with the actuating device, the clamping device including a rod movably positioned in the locator bore and at least one finger movably located in the aperture and coupled with the rod;

a member extending from the rod or the finger and a slot on the rod or the finger, an extending member of the rod or finger is received in the slot of the other of the rod or finger, wherein reciprocation of the rod in the locator bore moves the at least one finger in the aperture between an extended and a retracted position, and in the extended position, the rod moves the locator pin and the at least one finger into a clamping position.

2. The pin clamp of claim 1, wherein the rod includes an annular flange that moves in an enlarged bore portion in the locator pin.

3. The pin clamp of claim 1, wherein the extending member is a tapered surface.

4. The pin clamp of claim 1, wherein the rod includes a flat planar head with the extending member on at least one side.

5. The pin clamp of claim 1, wherein a connecting rod couples between the rod and the actuating device, the connecting rod positioned in the housing cavity.

6. The pin clamp of claim 2, wherein a stop is positioned in the enlarged bore portion for contacting the rod flange.

7. The pin clamp of claim 1 wherein a pin extends from the rod or finger.

* * * * *